US009347681B2

(12) United States Patent
Jiang et al.

(10) Patent No.: US 9,347,681 B2
(45) Date of Patent: May 24, 2016

(54) CLEANROOM

(71) Applicant: Shenzhen China Star Optoelectronics Technology Co., Ltd., Shenzhen, Guangdong (CN)

(72) Inventors: Yunshao Jiang, Shenzhen (CN); Chunhao Wu, Shenzhen (CN); Kunhsien Lin, Shenzhen (CN); Yongqiang Wang, Shenzhen (CN); Zhiyou Shu, Shenzhen (CN); Zhenhua Guo, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 740 days.

(21) Appl. No.: 13/642,545

(22) PCT Filed: Oct. 9, 2012

(86) PCT No.: PCT/CN2012/082617
§ 371 (c)(1),
(2) Date: Oct. 21, 2012

(87) PCT Pub. No.: WO2014/047960
PCT Pub. Date: Apr. 3, 2014

(65) Prior Publication Data

US 2014/0087650 A1 Mar. 27, 2014

(30) Foreign Application Priority Data

Sep. 26, 2012 (CN) ..... 2012 1 0363872

(51) Int. Cl.
*B01L 1/04* (2006.01)
*F24F 13/28* (2006.01)
*F24F 3/16* (2006.01)

(52) U.S. Cl.
CPC ..... *F24F 13/28* (2013.01); *F24F 3/161* (2013.01)

(58) Field of Classification Search
CPC ..... F24F 13/28; F24F 3/161; F24F 3/1607; F24F 7/10; H01L 21/67017
USPC ..... 454/187
See application file for complete search history.

(56) References Cited

U.S. PATENT DOCUMENTS 3,942,964 A * 3/1976 Shuler ..... E04F 15/02405 454/187
5,752,985 A * 5/1998 Nagafune et al. ..... 29/25.01
6,050,774 A * 4/2000 LeBaron ..... 415/121.2
6,321,637 B1 * 11/2001 Shanks et al. ..... 95/273
6,368,393 B1 * 4/2002 Hironaka ..... 96/111

(Continued)

FOREIGN PATENT DOCUMENTS

CN 101143644 A 3/2008
JP 11-130210 A 5/1999

*Primary Examiner* — Helena Kosanovic
(74) *Attorney, Agent, or Firm* — Andrew C. Cheng

(57) ABSTRACT

The present invention provides a cleanroom for storing glass substrates, and which comprises an exhaust is disposed on a bottom floor of the cleanroom. A first filtering device is arranged on a ceiling of the cleanroom to provide purified airflow to the cleanroom. A second filtering device is arranged on the bottom floor of the cleanroom jointly to create a vertical airflow with the first filtering device so as to reduce the turbulence within the cleanroom. The present invention can readily resolve the prior art issue in which the airborne particles stirred by turbulence within the cleanroom cannot be effectively eliminated.

10 Claims, 3 Drawing Sheets

(56) References Cited

U.S. PATENT DOCUMENTS 6,368,939 B1 * 4/2002 Sasaki ..... 438/421
7,674,440 B2 * 3/2010 Martin ..... 422/295
7,694,817 B2 * 4/2010 Ikehata ..... 206/454
7,964,817 B2 * 6/2011 MacGregor ..... 219/69.17
2009/0245985 A1 * 10/2009 Matsuba ..... 414/270

* cited by examiner

CLEANROOM

FIELD OF THE INVENTION

The present invention relates to a technical field of manufacturing of a liquid crystal display device, and more particularly to a cleanroom.

DESCRIPTION OF PRIOR ART

Cleanroom is also referred to as dust-free room remained with a low level of environmental pollutants, such as dust, airborne microbes, aerosol particles and chemical vapors. More accurately, a cleanroom has a controlled level of contamination that is specified by the number of particles per cubic meter at a specified particle size. In the field of manufacturing a high tech product, such as a glass substrate used to make liquid crystal display device, the cleanness, temperature and humidity of the environment have to be controlled to within a controlled range so as to ensure the glass substrate manufactured therefrom meet the preset requirements.

In the existing cleanroom, an inlet with a filter is arranged on a ceiling of the cleanroom so as to provide cleaning air to the cleanroom, while an outlet is used to dram out the air or polluted air, including airborne particles from the cleanroom.

However, in the actual practice, the airflow coming out of the filtering device arranged on the ceiling can be readily disturbed by the movement of a transporting apparatus, and the turbulence when the airflow hits the bottom floor and the sidewalls. As a result, the turbulence will create a stir of the airborne particles such that to make it is impossible to be effectively drawn out. Consequently, the glass substrates within the cleanroom will be contaminated.

SUMMARY OF THE INVENTION

It is an object of the present invention to provide a cleanroom in which the airborne particles stirred by the turbulence can be readily drawing out.

In order to resolve the issues encountered by the prior art, the present invention provides a technical solution by introducing a cleanroom for storing glass substrates and which comprises:

An exhaust is disposed on a bottom floor of the cleanroom.

A first filtering device is arranged on a ceiling of the cleanroom to provide purified airflow to the cleanroom.

A second filtering device is arranged on the bottom floor of the cleanroom jointly to create a vertical airflow with the first filtering device so as to reduce the turbulence within the cleanroom.

The first filtering device includes:

A preliminary filter is used to purify incoming airflow.

An intake having one end interconnected to the preliminary filter.

A housing with another end of the intake interconnected thereto.

An electrical motor is disposed within the housing.

A fan is coupled to the electrical motor.

An airflow regulator is arranged under the fan to balance the airflow.

A filter is disposed under the airflow regulator for filtering the airflow a second time.

A metallic protective screen is disposed on a bottom of the housing.

At least a leg portion is disposed under the bottom to fixedly attach to the ceiling and the bottom floor.

A controlling unit is used to operate the electrical motor.

In order to resolve the issues encountered by the prior art, the present invention provides a technical solution by introducing a cleanroom for storing glass substrates, and which comprises:

An exhaust is disposed on a bottom floor of the cleanroom.

A first filtering device is arranged on a ceiling of the cleanroom to provide purified airflow to the cleanroom.

A second filtering device is arranged on the bottom floor of the cleanroom jointly to create a vertical airflow with the first filtering device so as to reduce the turbulence within the cleanroom.

According to one preferred embodiment, the cleanroom includes a ceiling and a bottom floor. The first filtering device is arranged onto the ceiling, and the exhaust is arranged on the bottom floor and the second filtering device is disposed on top of the exhaust.

According to a preferred embodiment of the present invention, the first filtering device and the second filtering device are arranged in-line with each other.

According to a preferred embodiment, wherein the cleanroom includes storing towers arranged onto the bottom floor for storing trays in which glass substrates are stored therein.

According to a preferred embodiment, wherein the cleanroom includes guiderail system disposed on the bottom floor.

According to a preferred embodiment, wherein the cleanroom includes an automatic transporting apparatus moveably arranged on the guiderail system.

According to a preferred embodiment of the present invention, wherein the automatic transporting apparatus includes a forklift for moving the tray disposed within the storing tower.

According to a preferred embodiment of the present invention, wherein the guiderail system has two rails dividing the bottom floor into internal zone and external zone.

According to a preferred embodiment, the second filtering device is arranged within the internal zone.

According to a preferred embodiment, the second filtering device is arranged on the external zone.

According to a preferred embodiment, wherein the second filtering device is arranged in both the internal and external zones.

According to a preferred embodiment, each of the first and second filtering devices includes:

A preliminary filter is used to purify incoming airflow.

An intake having one end interconnected to the preliminary filter.

A housing with another end of the intake interconnected thereto.

An electrical motor is disposed within the housing.

A fan is coupled to the electrical motor.

An airflow regulator is arranged under the fan to balance the airflow.

A filter is disposed under the airflow regulator for filtering the airflow a second time.

A metallic protective screen is disposed on a bottom of the housing.

At least a mounting leg is disposed under the bottom to fixedly attach to the ceiling and the bottom floor.

A controlling unit is used to operate the electrical motor.

The present invention can be concluded with the following advantages. As compared to the prior art, the cleanroom provided by the present invention can readily resolve the problem encountered by the prior art as the airborne particles stirred by the turbulence cannot readily filtered. With the provision of the present invention, the bottom floor of the cleanroom is installed with a filtering device and which creates a vertical airflow along with another filtering device mounted on the ceiling. By this arrangement, the turbulence within the cleanroom can be effectively eliminated. As a result, the airborne particles will not be stirred up to contaminate the glass substrate. The yield is therefore increased.

In order to give a better and thorough understanding, to the whole and other intended purposes, features and advantages of the technical solution of the present invention, detailed description will be given with respect to preferred embodiments provided and illustrated herebelow in accompanied drawings. Apparently, with the spirit of the embodiments disclosed, person in the skilled in the art can readily come out with other modifications as well as improvements without undue experiment. In addition, other drawings can be readily achieved based on the disclosed drawings. Wherein FIG. 1 is an illustrational sectional view of the cleanroom made in accordance with a preferred embodiment of the present invention;

DETAILED DESCRIPTION OF PREFERRED EMBODIMENT

Figure 1:
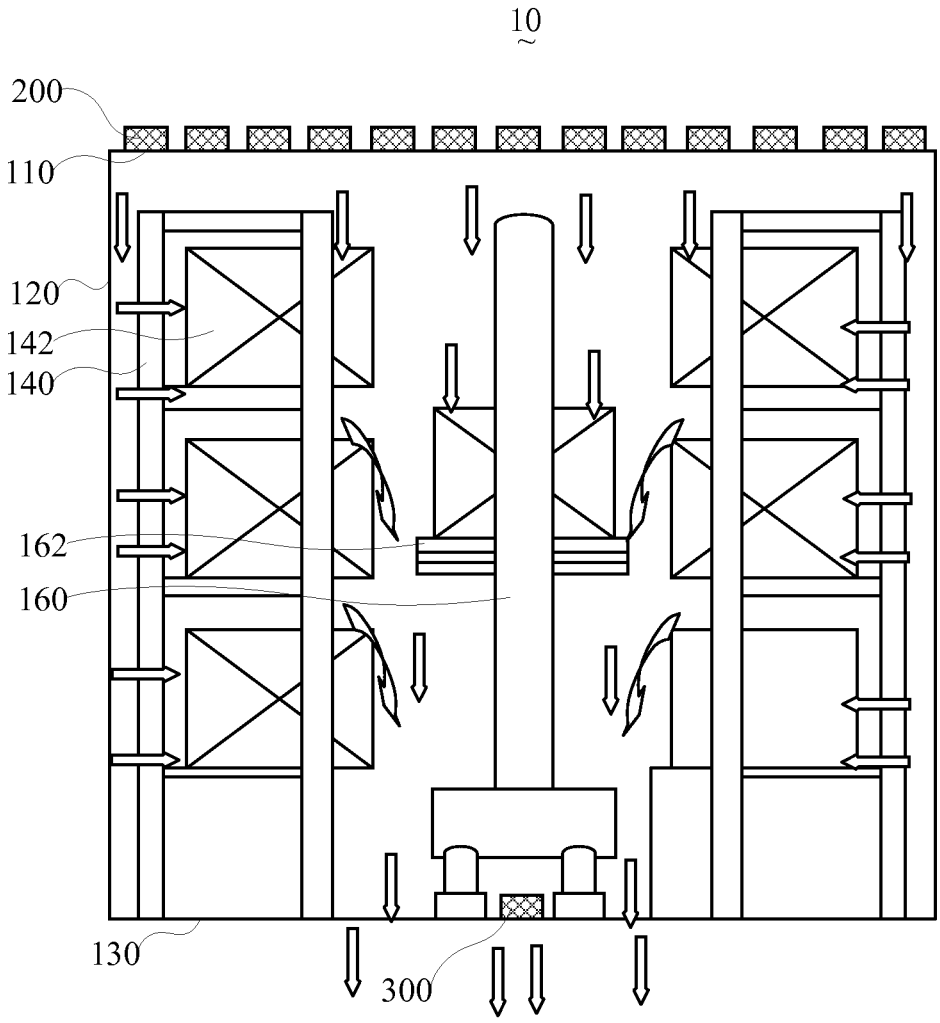

In order clearly explain the technology of the embodiment illustrated in the present invention, a brief and concise description will be given along with the accompanied drawings. Apparently, the embodiments illustrated in the drawings are merely some typical embodiments and which can be readily modified by the skilled in the art without any additional laborious efforts so as to transform them into other drawings, and they should all be covered by the appended claims.

Figure 2:
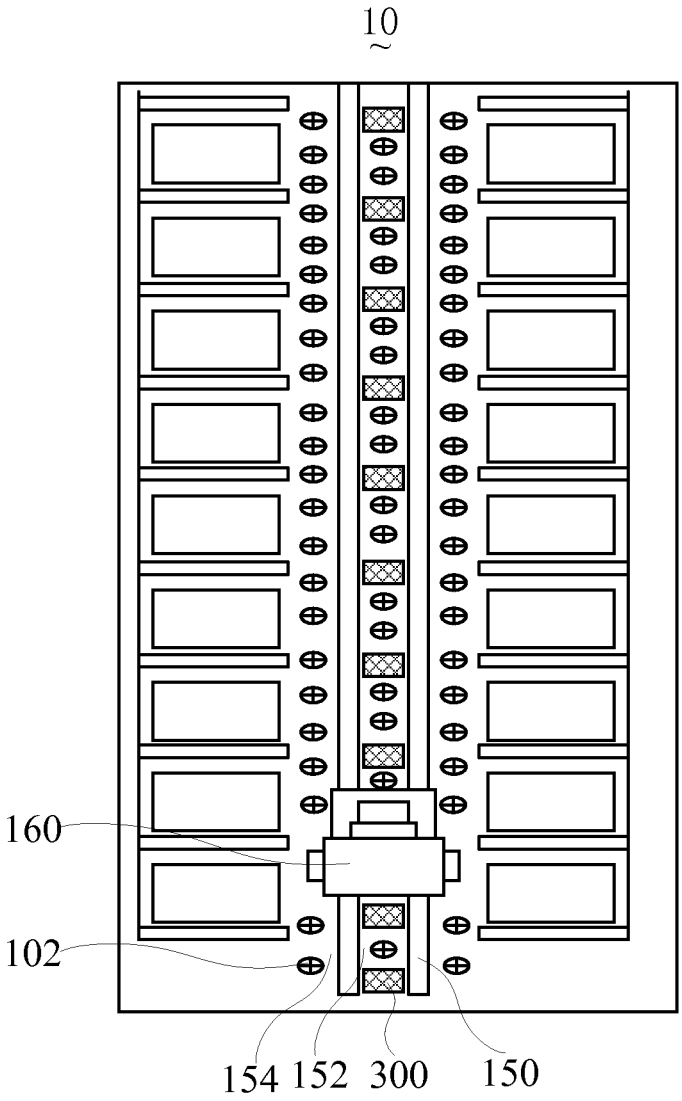
FIG. 2 is still a cross sectional view of the cleanroom made in accordance with the present invention taken from above.

Referring to FIGS. 1 and 2, FIG. 1 is an illustrational sectional view of the cleanroom made in accordance with a preferred embodiment of the present invention, and FIG. 2 is still a cross sectional view of the cleanroom made in accordance with the present invention taken from above.

Referring to FIGS. 1 and 2, a cleanroom 10 is provided for storing glass substrates. The cleanroom 10 includes an exhaust 102, a first filtering device 200, and a second filtering device 300.

The exhaust 102 is arranged on a bottom floor of the cleanroom 10, and the first filtering device 200 is deposed on a ceiling of the cleanroom 10 to provide purified airflow. The second filtering device 300 is arranged on the bottom floor of the cleanroom 10 and arranged in-line with the first filtering device 200 so as to create a vertical airflow to reduce the turbulence within the cleanroom 10.

As compared to the existing prior art, the cleanroom 10 provided by the present invention can readily reduce and prevent the turbulence so as to reduce the stir of the airborne particles. As a result, with the reduction of the airborne particles, the maintenance of the cleanroom 10 can be reduced as well. By this arrangement, cost of maintaining of the cleanroom 10 can be saved.

Substantially, the cleanroom 10 made in accordance with the present invention is configured with the ceiling 110, a sidewall 120, and the bottom floor 130. The cleanroom 10 includes a storing tower 140, a guiderail system 150, an automatic transporting apparatus 160, the first filtering device 200, and the second filtering device 300.

The ceiling 110 is configured with a plurality of unit ceiling, and a plurality of mounting ports are arranged on the ceiling 110. The first filtering device 200 is installed on the mounting port so as to provide purified airflow into the cleanroom 10 through the mounting port.

The first filtering unit 200 can be selected from a fan filter unit (FFU) available from the market. The FFU is a combination of a blower and a filter, for example, a HEPA (High-Efficiency Particulate Air) filter, a ULPA (Ultra Low Penetration Air) filters. This kind of filter is self-propelling filter as a blower is incorporated therein. Substantially, this kind of filter can be referred to as a filtering module which includes the filter and blower to provide purified airflow. Basically, the blower sucks in the air, and then force the airflow to pass through the HEPA, and then deliver the purified airflow with a speed of 0.45 m/s±20%. The high-performance filter can effectively remove the airborne particles with a diameter of 0.3 μm up to 99.97%, which is about one two hundredth of human hair. This high-performance filter can effectively remove the smoke, dust, and even airborne fungus. The super-high-performance filter can effectively remove the smoke, dust, and fungus with a dimension of 0.1~0.2 μm. Its performance can reach up to 99.97%.

In fact, the cleanroom 10 is configured with the sidewall 120 which is configured with four unit sidewalls, and along with the ceiling 110, and the bottom ceiling 130.

The bottom floor 130 is high-rise arrangement with respect to the ground level. The bottom floor 130 is also configured with unit floor. As shown in FIG. 2, the bottom floor 130 is arranged with three exhausts 102. Of course, the arrangement, manner and way of arranging the exhaust 102 should not be limited to what disclosed in FIG. 2.

The storing tower 140 is disposed on the bottom floor 130, and in which trays 142 are stored therein. The tray 142 is used to store glass substrate. As shown in FIGS. 1 and 2, the storing tower 140 is arranged on each side of the cleanroom 10. The storing tower 140 can also be configured with multiple unit towers.

The guiderail system 150 is disposed on the bottom floor 130. The guiderail system 150 has two rails, and divides the bottom floor 130 into the internal zone 152 and external zone 154. In the preferred embodiment, the guiderail system 150 is arranged between the storing towers 140.

The automatic transporting apparatus 160 is moveably arranged onto the guiderail system 150. The automatic transporting apparatus 160 is incorporated with a forklift 162 for disposing and removing the tray 142 to and from the storing tower 140.

The second filtering device 300 can be configured the FFU identical to the first filtering device 200. Alternatively, the second filtering device 300 can be incorporated with a generic blower. The second filtering device 300 is disposed onto the exhaust 102. Of course, the number of the second filtering device 300 can be lower than the number of the exhaust 102. Normally, the second filtering device 300 mounted on the bottom floor 130 is in-line with the first filtering device 110 mounted on the ceiling 110 so as to create a vertical airflow.

In the preferred embodiment, the second filtering device 300 is arranged on the internal zone 152 and which means that the second filtering device 300 is located substantially between the storing towers 140. By this arrangement, the real estate within the cleanroom 10 can be effectively utilized. Of course, in other preferred embodiment, the second filtering device can be arranged in the external zone 154, or alternatively, the second filtering devices 300 can be arranged both the internal zone 152 and the external zone 154.

Figure 3:
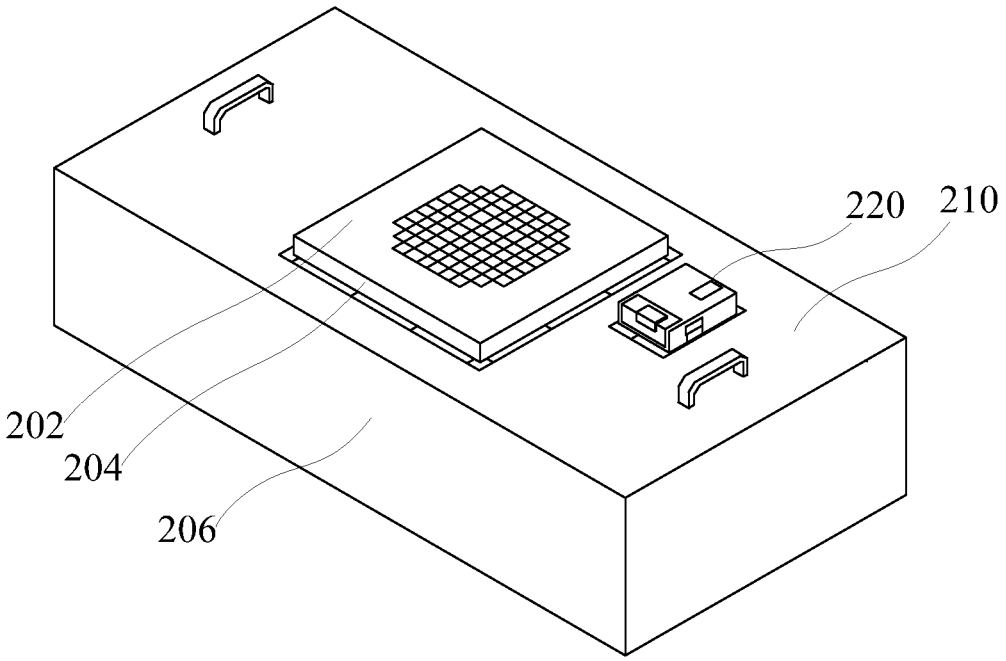
FIG. 3 is a perspective view of the cleanroom made accordance with the present invention showing the cleanroom and a first filtering device disposed thereon.
Figure 4:
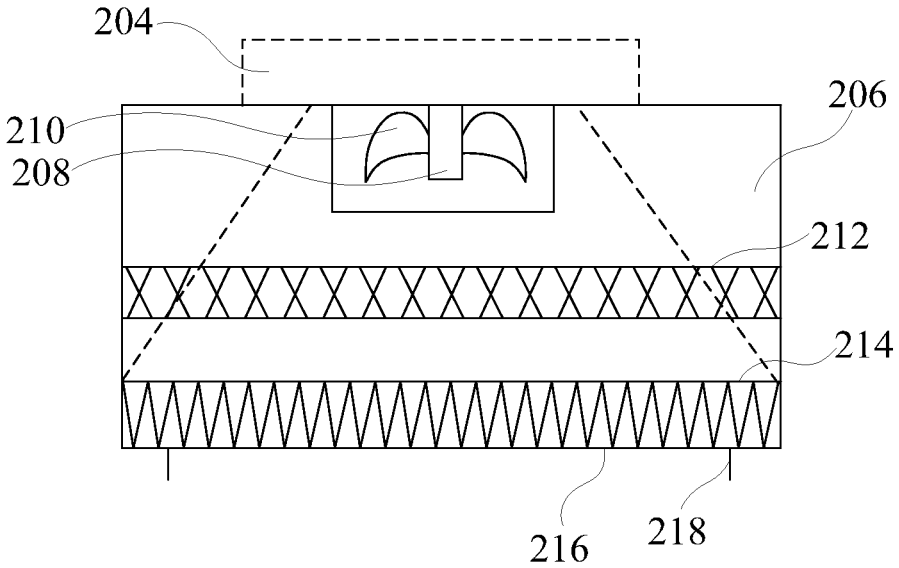
FIG. 4 is an illustration showing the working principle of the first filtering device.

Referring now to FIGS. 3 and 4, FIG. 3 is a perspective view of the cleanroom made accordance with the present invention showing the cleanroom and a first filtering device disposed thereon; and FIG. 4 is an illustration showing the working principle of the first filtering device.

As shown in FIGS. 3 and 4, the first filtering device 200 includes a preliminary filter 202, an intake 204, as housing 206, an electrical motor 208, a fan 210, an airflow regulator 212, as filter 214, a metallic protective screen 216, a mounting leg 210, and a controlling unit 220.

Wherein the preliminary filter 202 is used to purify the inhaled airflow. An end of the intake 204 is interconnected to the preliminary filter 202, and the other end of the intake 204 is interconnected to a top of the housing 206. The electrical motor 208 is disposed within the housing 206 and in a position corresponding to the intake 20. The fan 210 is coupled to the electrical motor 208. The airflow regulator 212 is arranged under the fan 210 to regulate the airflow. The filter 214 is disposed under the airflow regulator 212 so as to filter the airflow again. The metallic screen 216 is disposed on the bottom of the housing 206. The mounting legs 218 are disposed on the bottom of the housing 206 so as to be anchored onto the ceiling 110 and the bottom floor 130. The controlling unit 220 is used to operate the electrical motor 208.

In conclusion cleanroom provided by the present invention can readily resolve the problem encountered by the prior art as the airborne particles stirred by the turbulence cannot readily filtered. With the provision or the present invention, the bottom floor of the cleanroom is installed with a filtering device and which creates a vertical airflow along with another filtering device mounted on the ceiling. By this arrangement, the turbulence within the cleanroom can be effectively eliminated. As a result, the airborne particles will not be stirred up to contaminate the glass substrate. The yield is therefore increased.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

The invention claimed is:

1. A cleanroom for storing glass substrates, comprising an exhaust disposed on a bottom floor of the cleanroom;

a first filtering device arranged on a ceiling of the cleanroom to provide purified airflow to the cleanroom;

a second filtering device including a blower and arranged on the bottom floor of the cleanroom to be spaced from and opposite to the first filtering device and to jointly create a vertical airflow with the first filtering device so as to reduce the turbulence within the cleanroom;

wherein the first filtering device includes, a preliminary filter used to draw in and purify incoming airflow;

an intake having one end interconnected to the preliminary filter;

a housing with another end of the intake interconnected thereto;

an electrical motor disposed within the housing;

a fan coupled to the electrical motor and driving the incoming airflow from the first filtering device in a vertical direction toward the second filtering device to generate the vertical airflow;

an airflow regulator arranged under the fan to balance the airflow;

a filter disposed under the airflow regulator for filtering the airflow a second time;

a metallic protective screen is disposed on a bottom of the housing;

at least a mounting leg disposed under the bottom to fixedly attach to the ceiling and the bottom floor; and a controlling unit is used to operate the electrical motor; and wherein the blower of the second filtering device is arranged opposite to the fan of the first filtering device so as to guide and additionally drive the vertical airflow to move in the vertical direction for being discharged directly to the outside of the cleanroom, where the airflow moves directly through the cleanroom in the vertical direction.

2. A cleanroom for storing glass substrates, comprising an exhaust disposed on a bottom floor of the cleanroom;

a first filtering device arranged on a ceiling of the cleanroom to draw in air and provide purified airflow into the cleanroom, the first filtering comprising a fan that drives the airflow in a vertical direction; and a second filtering device including a blower and arranged on the bottom floor of the cleanroom to be spaced from and opposite to the first filtering device and to jointly create a vertical airflow with the first filtering device so as to reduce the turbulence within the cleanroom; and wherein the blower of the second filtering device is arranged opposite to the fan of the first filtering device so as to guide and additionally drive the vertical airflow to move in the vertical direction for being discharged directly to the outside of the cleanroom, where the airflow moves directly through the cleanroom in the vertical direction, wherein each of the first and second filtering devices includes a preliminary filter used to purify incoming airflow;

an intake having one end interconnected to the preliminary filter;

a housing with another end of the intake interconnected thereto;

an electrical motor disposed within each of the first and the second filtering device and coupled to the fan and the blower respectfully;

an airflow regulator arranged under the fan to balance the airflow;

a filter disposed under the airflow regulator for filtering the airflow a second time;

a metallic protective screen disposed on a bottom of the housing;

at least a mounting leg disposed under the bottom to fixedly attach to the ceiling and the bottom floor; and a controlling unit used to operate the electrical motor.

3. The cleanroom as recited in claim 2, wherein the first filtering device is arranged onto the ceiling, and the exhaust is arranged on the bottom floor and the second filtering device is disposed on top of the exhaust.

4. The cleanroom as recited in claim 3, wherein the first filtering device and the second filtering device are arranged in-line with each other.

5. The cleanroom as recited in claim 4, wherein the cleanroom includes storing towers which are arranged onto the bottom floor for storing trays in which glass substrates are stored.

6. The cleanroom as recited in claim 5, wherein the cleanroom includes guiderail system which is mounted onto the bottom floor.

7. The cleanroom as recited in claim 6, wherein the cleanroom includes an automatic transporting apparatus moveably arranged on the guiderail system.

8. The cleanroom as recited in claim 7, wherein the automatic transporting apparatus includes a forklift for moving the tray disposed within the storing tower.

9. The cleanroom as recited in claim 8, wherein the guiderail system has two rails dividing the bottom floor into an internal zone and an external zone.

10. The cleanroom as recited in claim 9, wherein the second filtering device is disposed in the internal zone.

* * * * *